US009336728B2

(12) United States Patent
Neal

(10) Patent No.: US 9,336,728 B2
(45) Date of Patent: May 10, 2016

(54) SYSTEM AND METHOD FOR CONTROLLING A DISPLAY BACKLIGHT

(75) Inventor: Greg Neal, Morgan Hill, CA (US)

(73) Assignee: STMICROELECTRONICS, INC., Carrollton, TX (US)

( * ) Notice: Subject to any disclaimer, the term of this patent is extended or adjusted under 35 U.S.C. 154(b) by 1302 days.

(21) Appl. No.: 12/780,721

(22) Filed: May 14, 2010

(65) Prior Publication Data

US 2011/0279482 A1 Nov. 17, 2011

(51) Int. Cl.
*G09G 3/34* (2006.01)

(52) U.S. Cl.
CPC ..... *G09G 3/3426* (2013.01); *G09G 2320/0238* (2013.01); *G09G 2320/0285* (2013.01); *G09G 2360/16* (2013.01)

(58) Field of Classification Search
CPC ..... G09G 2320/0285; G09G 3/3406; G09G 3/3426
USPC ..... 345/102, 690–696
See application file for complete search history.

(56) References Cited

U.S. PATENT DOCUMENTS

| | | | | |
|---|---|---|---|---|
| 8,223,116 | B2 | 7/2012 | Lee et al. | |
| 8,766,904 | B2 | 7/2014 | Neal | |
| 2003/0201968 | A1* | 10/2003 | Itoh et al. | 345/102 |
| 2006/0061538 | A1 | 3/2006 | Dispoto et al. | |
| 2006/0146005 | A1* | 7/2006 | Baba et al. | 345/102 |
| 2007/0152926 | A1 | 7/2007 | Kwon | |
| 2009/0021469 | A1 | 1/2009 | Yeo et al. | |
| 2009/0135108 | A1 | 5/2009 | Lindfors et al. | |
| 2009/0273558 | A1* | 11/2009 | Lee | 345/102 |
| 2009/0289961 | A1* | 11/2009 | Kim et al. | 345/690 |
| 2009/0303167 | A1 | 12/2009 | Mori et al. | |
| 2010/0103089 | A1 | 4/2010 | Yoshida et al. | |
| 2011/0227940 | A1 | 9/2011 | Neal | |

* cited by examiner

*Primary Examiner* — Dennis Joseph
(74) *Attorney, Agent, or Firm* — Slater Matsil, LLP

(57) ABSTRACT

In one embodiment, a backlight controller for a zoned backlight display includes a processor having a brightness value output. The processor is configured to provide a brightness value for at least one brightness zone of the display based on a target brightness value for the at least one zone, a past brightness value of the at least one zone, and a brightness time response.

16 Claims, 7 Drawing Sheets

SYSTEM AND METHOD FOR CONTROLLING A DISPLAY BACKLIGHT

TECHNICAL FIELD

This invention relates generally display devices, and more particularly to a system and method for controlling a display backlight.

BACKGROUND

Liquid crystal displays (LCDs) have been used for many years as display devices. Originally, LCD devices served as low-speed monochromatic displays for clocks, and status indicators for electronic devices. More recently, however, LCD devices have been used in full color displays for computers, navigation systems and televisions.

Some high quality LCD display devices, such as those used for computer monitors and television displays, include a backlit LCD pixel panel. The LCD pixel panel contains an array of red, green and blue pixels disposed over a light source. By electronically controlling the transparency of each pixel, an image is generated on the LCD pixel panel.

Conventionally, backlights have been constructed using light sources such as incandescent light bulbs, an electroluminescent panel (ELP), one or more cold cathode fluorescent lamps (CCFL), and hot cathode fluorescent lamps (HCFL). In some cases, a light diffuser is used to provide even illumination from uneven light sources. Most recently, however, arrays of light emitting diodes (LEDs) have been employed in back lights. Display devices using LED backlighting have made very thin flat panel displays possible due to the low power and compact size of the LEDs.

One limitation of many commercially available LCD display devices is the inability of pixels on the pixel panel to become completely opaque, thereby allowing light to leak through the display in regions where pixels are designated to be off. This effect, commonly known as "black light leakage," reduces picture contrast and makes black areas of the picture appear grey in color.

SUMMARY

In one embodiment, a backlight controller for a zoned backlight display includes a processor having a brightness value output. The processor is configured to provide a brightness value for at least one brightness zone of the display based on a target brightness value for the at least one zone, a past brightness value of the at least one zone, and a brightness time response.

In another embodiment, a method of operating a display having a pixel plane and a zoned backlight including a brightness zone is disclosed. The method includes providing a present brightness for the brightness zone based on present input pixel data, providing a past brightness for the brightness zone based on past input pixel data, providing a brightness time response for transitioning from the past brightness to the present brightness over a first time period, and changing a brightness of the brightness zone according to the brightness time response over the first time period.

In a further embodiment, a display system includes a multi-zone light emitting diode (LED) backlight disposed behind a liquid crystal display (LCD) pixel plane, a backlight controller, and a pixel plane controller coupled the LCD pixel plane. The backlight controller is coupled to a brightness input of at least one zone of the multi-zone LED backlight. In an embodiment, the backlight controller is configured to provide a brightness value for the at least one zone based on a target brightness value for the at least one zone, a past brightness value for the at least one zone, and a brightness time response. The backlight controller determines the target brightness value and the past brightness value based on pixel data for the at least one zone.

The foregoing has outlined, rather broadly, features of the present disclosure. Additional features of the disclosure will be described, hereinafter, which form the subject of the claims of the invention. It should be appreciated by those skilled in the art that the conception specific embodiment disclosed may be readily utilized as a basis for modifying or designing other structures or processes for carrying out the same purposes of the present disclosure. It should also be realized by those skilled in the art that such equivalent constructions do not depart from the spirit and scope of the invention as set forth in the appended claims.

BRIEF DESCRIPTION OF THE DRAWINGS

For a more complete understanding of the present disclosure, and the advantages thereof, reference is now made to the following descriptions taken in conjunction with the accompanying drawings, in which.

Figure 1A:
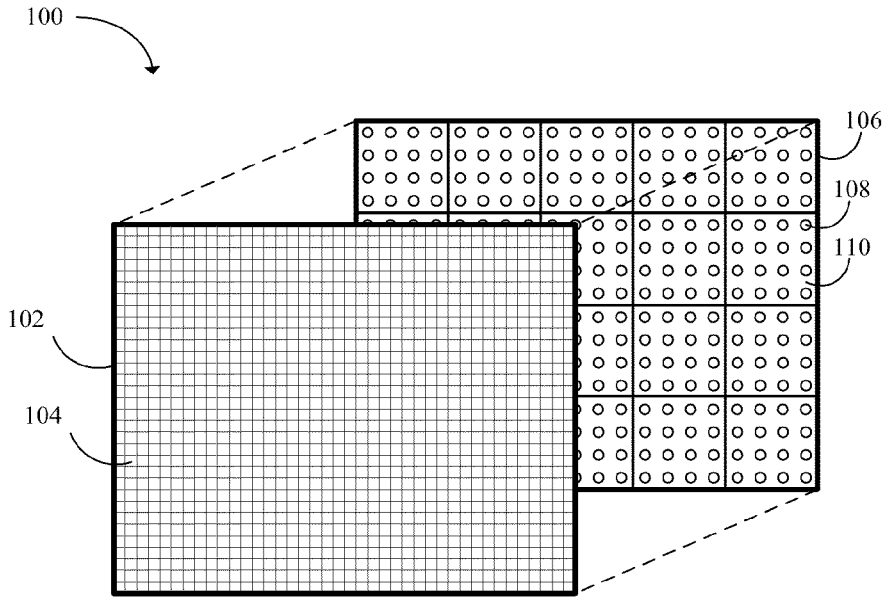
FIGS. 1*a*-1*b* illustrate a pixel plane and backlight for an embodiment display system.

Corresponding numerals and symbols in different figures generally refer to corresponding parts unless otherwise indicated. The figures are drawn to illustrate clearly the relevant aspects of embodiments of the present disclosure and are not necessarily drawn to scale. To more clearly illustrate certain embodiments, a letter indicating variations of the same structure, material, or process step may follow a figure number.

DETAILED DESCRIPTION OF ILLUSTRATIVE EMBODIMENTS

The making and using of embodiments are discussed in detail below. It should be appreciated, however, that the present disclosure provides many applicable inventive concepts that may be embodied in a wide variety of specific contexts. The specific embodiments discussed are merely illustrative of specific ways to make and use the invention, and do not limit the scope of the invention.

The present disclosure will be described with respect to embodiments in a specific context, namely a system and method for controlling a multi-zone LED display backlight in an LCD display system. Embodiments, of the present disclosure can also be applied to other systems and methods for visual displays.

One way in which black light leakage can be reduced is by using a multi-zone LED backlight system. In an embodiment, the display backlight is divided into a grid of individually controlled backlight sections. By using higher backlight illumination in zones corresponding to bright portions of the picture and using lower backlight illumination in zones corresponding to darker portions of the picture, a high contrast can be achieved in embodiments. For example, dark portions appear darker by decreasing the backlight illumination of portions of the picture.

In an embodiment, the intensity of each backlight zone is adjusted based on the image brightness in each zone based on pixel data. When an object is moving quickly across the screen, however, a potential for imbalance between the backlight intensity and the pixel plane transparency exists because the backlight LEDs have a very fast transient response and the LCD pixel panel has a relatively slow response. For example, an LED can be turned on in less than 1 μs, while an element in the LCD pixel panel may take a few milliseconds to respond to a change in pixel transparency. Given this transient imbalance, the resulting picture can exhibit artifacts such as motion blurring and flicker. For example, if the intensity of a brightness zone is changed at the same time that the corresponding panel pixel data is changed, the resulting temporary imbalance is created between the backlight and the pixel plane, which can create a noticeable dark or bright flash.

In embodiments of the present disclosure, the illumination intensity of the backlight LEDs is dynamically controlled to compensate for the dynamic response of the LCD pixel array. For example, in one embodiment, the a backlight LED is gradually turned on and off according to the transparency change vs. time response of the pixel panel.

FIG. 1*a* illustrates embodiment LCD display device 100 having LCD pixel plane 102 disposed over multi-zone backlight panel 106. LCD pixel plane is made of pixels 104, which, in some embodiments, are made of red, green and blue LCD pixels whose transparence is controlled electronically. In other embodiments, the LCD pixels can be monochromatic and/or other pixel color schemes can be used. Backlight panel 106 is illuminated by LEDs 108 that are divided into independently controlled backlight zones 110. In one embodiment, the display is divided in to a grid of 24 columns by 16 rows for a total of 384 backlight zones. In alternative embodiments, greater or fewer zones can be implemented.

Figure 1B:
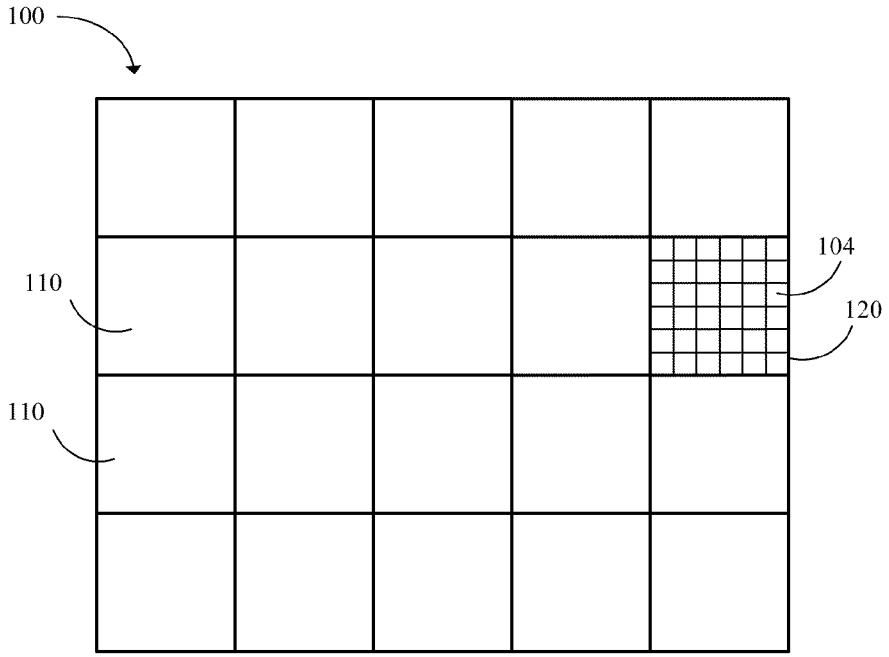

As shown in FIG. 1*b*, each backlight zone 110 is allocated a pixel group 120 made of pixels 104. In an embodiment, an intensity is calculated for each pixel group that is sufficient to render all pixels within that zone with no noticeable degredation, and a corresponding backlight intensity is derived for each frame. In further embodiments, each pixel value is adjusted according to the backlight intensity for each particular zone. In one embodiment, a pixel group is an array of 80 by 68 pixels. Alternatively, pixel groups can be of other dimensions depending on the application and its requirements.

As a simplified example, at a particular pixel location, such as 104, the initial light intensity $LI_1$ output at the particular pixel location can be defined as a function of input pixel value $PV_1$ and backlight intensity value $BL_1$ such that $LI_1=PV_1BL_1$. The new light intensity output at the pixel location after the backlight intensity value is decreased is defined as $LI_2=PV_2\ BL_2$. To maintain the light intensity output, $LI_2$ is set equal to $LI_1$ which yields, $$PV_2BL_2=PV_1BL_1.$$

Solving for PV2 yields, $$PV_2 = \frac{PV_1BL_1}{BL_2} = \frac{PV_1}{k},$$

where k is an adjustment made to the pixel value described above. Applying this simplified formula to a single zone and a single pixel associated with the zone, if the backlight in the zone is decreased by 20%, then $BL_2=0.8\ BL_1$ and 1/k=1.2. Thus, PV2=1.2 (PV1), i.e., the pixel value can be increased by 20% to maintain the light intensity output at the pixel.

The example above is a simple example in that it involves adjusting the backlight intensity value in one zone. In embodiments having multiple backlight zones, backlight intensity is adjusted in multiple zones simultaneously. Based on the backlight intensity over all of the backlight zones, a correction factor, k is determined for each pixel. After the determination, the pixel value of each pixel is modified by the correction factor to account for light originating from other zones. In some embodiments, k is determined for a group of pixels.

Figure 2A:
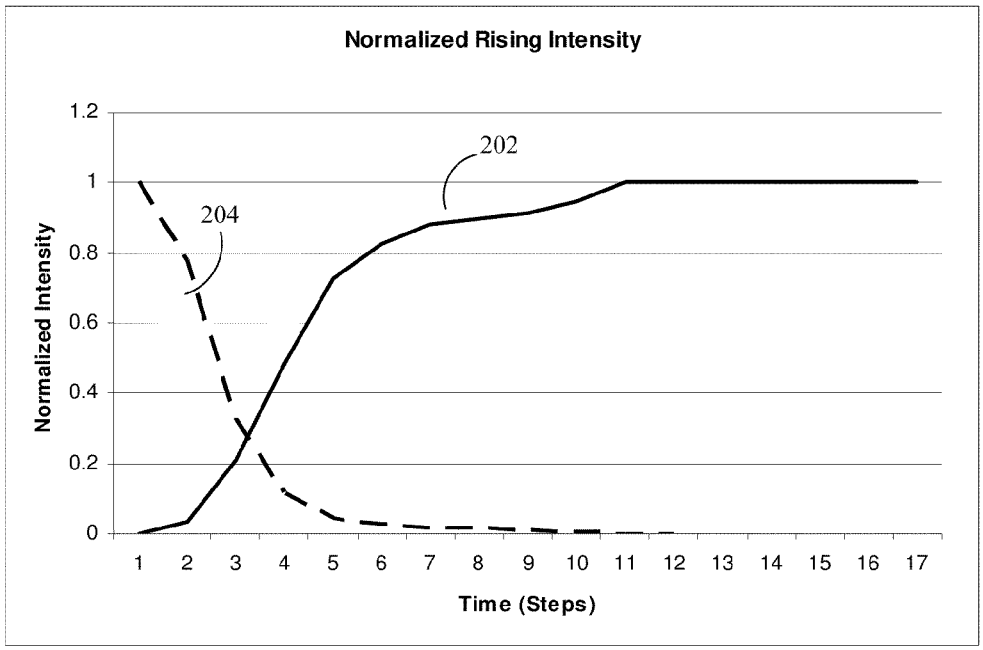
FIGS. 2*a*-2*b* illustrate graphs of embodiment pixel plane compensation curves.

In an embodiment, the transient response of LCD pixel panel 102 is compensated by controlling the intensity of each zone of the back light in according to an inverse characteristic of LCD pixel panel 102. FIG. 2*a* represents a graph of normalized rising intensity verses time. In this graph, each time step represents a time period of about 1 ms. Trace 202 is a normalized representation of pixel transmission with respect to time for a step input. At a normalized intensity of zero, the pixel is at its most opaque state, while at a normalized intensity of one, the pixel is at its most transparent state. As can be seen by the chart in FIG. 2*a*, it takes about eleven time steps for a pixel to go from its most opaque to its most transmissive state. It should be noted that FIG. 2*a* is just one example of a time response of an LCD panel. In other embodiment LCD panels, the time response of the panel will differ. Trace 204 represents a time response of back light intensity to compensate for the time response of trace 202. In some embodiments, the compensating back light intensity is based on an inverse of the LCD panel response. In other embodiments, the compensating response is a simplified approximation of the inverse of the LCD panel response.

Figure 2B:
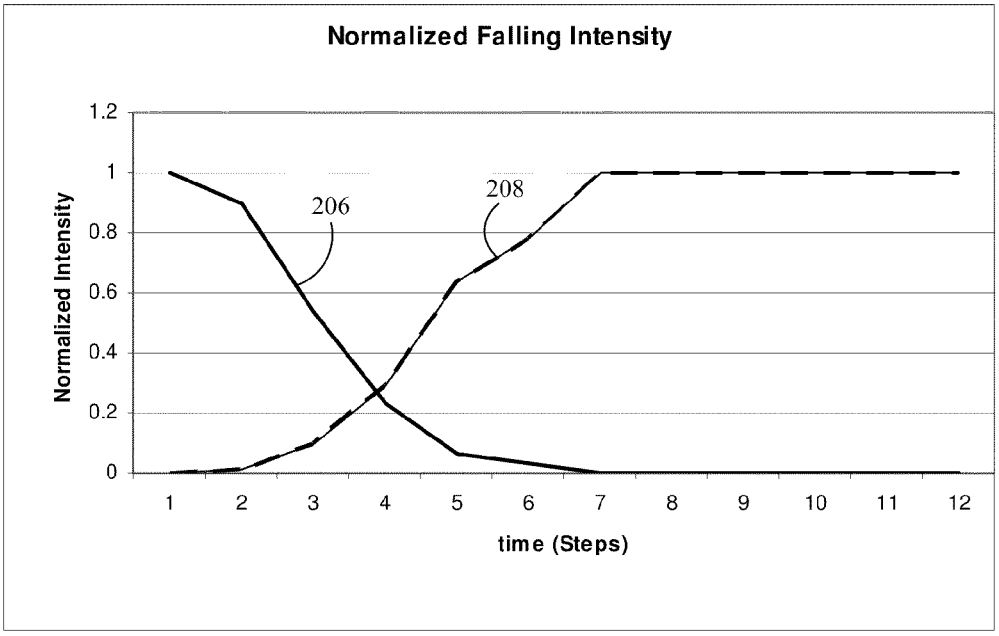

FIG. 2*b* illustrates a graph of an embodiment normalized falling intensity. Trace 206 represents a normalized pixel transmission versus time where a normalized intensity of 1 represents a pixel at its highest intensity and a normalized intensity of 0 represents a pixel at its lowest intensity. Here, the normalized falling response goes from its most tranmissive to its least transmissive state in seven time steps. Here each time step represents about 1 ms. It can be seen, in this embodiment, that the normalized rising intensity is slower than the normalized falling intensity. In some embodiments, LCDs turn off more slowly than they turn on. Trace 208 represents a time response for the backlight. When the pixel array is compensated in such a manner, the backlit pixel will appear to have a constant brightness to the extent that the compensating response matches the inverse of the pixel array response. In some embodiments, an approximation of the inverse pixel transient response is used to derive the backlight intensity. For example, a simple function, such as a ramp or other response can be used to approximate the pixel panel transient response.

Figure 3:
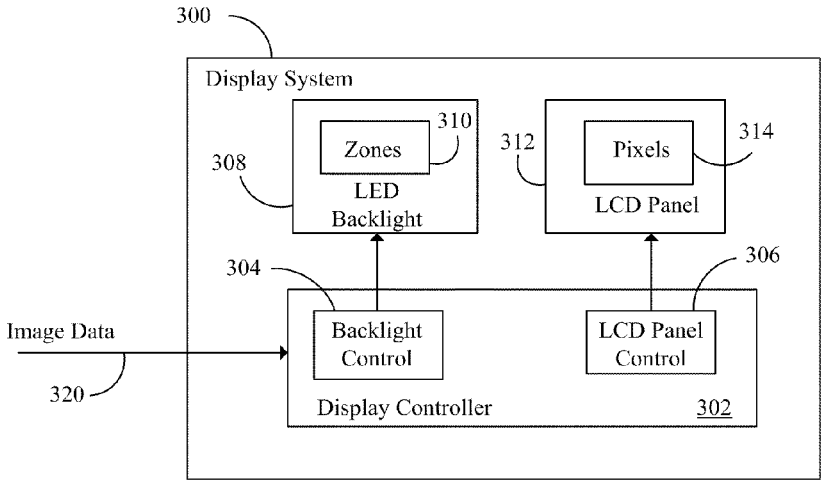
FIG. 3 illustrates an embodiment display system.

FIG. 3 illustrates LED backlit LCD display system 300 according to an embodiment. Display system 300 has display controller 302 having backlight control 304 and LCD panel control 306. Backlight control 304 is coupled to LED backlight 308 and provides light intensity control for backlight zones 310. LCD panel control 306 is coupled to LCD panel and provides pixel control to pixel array 314. Display controller 302 controls LED backlight 308 and LCD panel 312 according to input image data 320. In embodiments, display controller 302 is implemented using one or more microprocessors or microcontrollers. Alternatively, display controller can be implemented using, but not limited to one or more of microprocessors, memory elements, specialized processors, applications specific circuits (ASICs), general purpose integrated circuits, digital signal processors (DSP), for example. In some embodiments, display controller 302 also includes interface circuitry to interface with LED backlight 308 and LCD panel 312.

Figure 4:
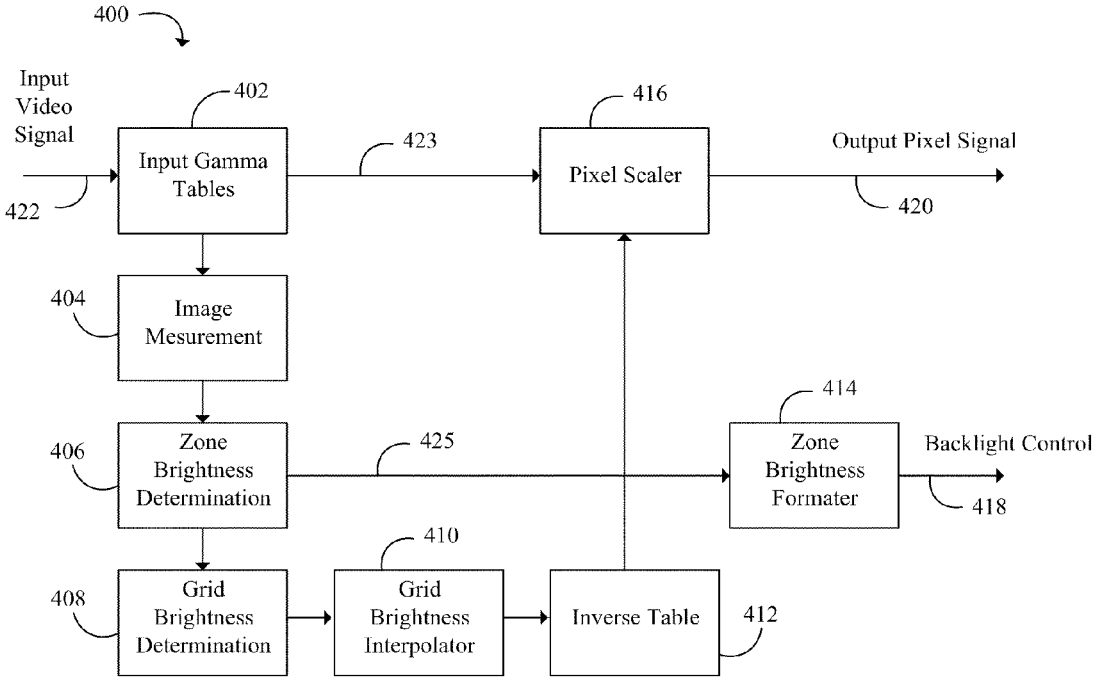
FIG. 4 illustrates a block diagram of an embodiment backlight controller.

FIG. 4 illustrates a block diagram of embodiment display controller 400. In an embodiment, input video signal 422 is adjusted by input gamma tables 402. In an embodiment, display controller 400 operates in a RGB color space. In order to preserve the integrity and accuracy of the video signal 422, video signal 422 is converted into a linear light space via input gamma tables 402. In an embodiment, in order to maintain a 10-bit precision of input video signal 422 in the gamma corrected light space the precision is set to 14-bits at the outputs of gamma tables 422. In an embodiment, controller 400 in its current form is implemented as a three channel device, one for each channel, red, green and blue. In alternative embodiments, other bit resolutions and other color spaces can be used, for example, a 12 bit input and a 16 bit output. In further embodiments, input gamma tables 402 can be omitted, for example, if the data is already linear and the panel is linear.

Image measurement block 404 measures input video signal 422 as processed by input gamma tables 402 and measures parameters related to zone brightness. In an embodiment, the display area is spatially divided into smaller rectangular zones and each zone into smaller grids. In one embodiment, the number of zones and grid is user programmable up to a maximum of 24 columns by 16 rows, for a total of 384 zones. Alternatively, a fixed number of zones can be used, or a maximum number of zones greater than or less than 384 zones can be used.

In an embodiment, the brightness of each zone is measured and the backlight individually adjusted based on the image content within that particular zone. To determine the amount of backlight for a particular zone, image content within that particular zone is measured. For example, if the zone is very dark or black, the amount of backlight can be significantly reduced. However, if there is a bright object of a significant size within a particular zone, in order to maintain the brightness of the bright parts of that object the backlight, the backlight intensity for the particular zone is increased. In some embodiments, if the object is very bright, the backlight is set to a full intensity.

In an embodiment, the size and distribution of bright objects is assessed within a particular zone as follows. In the horizontal direction, video the data is IIR filtered on a line-by-line basis, and a peak value is stored at the end of each zone. The maximum peak value is used as a measure of the size and brightness of the objects within a particular zone. In the vertical direction, an absolute maximum value for each line within the particular zone is also stored. These maximum values are then IIR filtered in the vertical direction and a new peak value is calculated. A blend of the above two values (one that measures the brightness distribution in the horizontal and one in the vertical direction) is then used as a reference for calculating the required backlight intensity for that particular zone. This procedure is done individually for each zone on the display. In alternative embodiments, many other measurement algorithms are possible.

In an embodiment, zone brightness determination block 406 calculates a backlight intensity for each zone. In an embodiment, stray light originating from other zones is not taken into consideration with respect to LED backlight intensity, rather stray light is accounted for when calculating the required pixel data correction in later stages. In alternative embodiments, however, stray light can also be taken into consideration when determining LED backlight intensity.

In one embodiment, zone brightness data for six consecutive frames is stored in memory. In other embodiments, greater than or less then six frames can be stored. After one frame is processed and a memory bank corresponding to that frame is filled up with zone brightness values, a circular buffer pointer increments and points to the next consecutive bank for storing the zone brightness for the next frame. The output of zone brightness determination block 406 is output to grid brightness determination block 408 and to zone brightness formatter 414.

Grid brightness determination block 408 determines correction factor k, as described above. In an embodiment, this correction factor is used to modulate the digital pixel data to compensate for the changed backlight brightness. In one embodiment, this correction factor is calculated using an algorithm that uses a look up table, for example, to decrease processing time and minimize the usage of expensive hardware blocks. Alternatively, the correction factor can be calculated directly using hardware and/or software. In an embodiment, the result of this calculation is used as an operand with which the original pixel data is divided with, in order to preserve the average brightness of the pixel. In other words, if the backlight is reduced by a certain percentage, the pixel data is increased by the same amount to preserve the average brightness of the pixel as seen by the viewer (or camera) in front of the screen. In some embodiments, grid brightness determination block 408 also takes into account "spilled light" from adjacent grids.

Due to the mechanical construction and optical characteristics of the backlight and panel, in some embodiments, there will be a spilled light from each of the zones affecting every other zone on the panel. This light is measured and stored in memory for reference. In an embodiment, this spilled light is modeled at grid resolution by a two-dimensional lookup table with a 2D LUT called a zone contour table. In an embodiment, the zone contour table is generated by taking a snapshot of the screen using a high precision camera, with a specific test pattern displayed and with a particular zone backlight illuminated. The backlight in all of the other zones is turned off. The captured image provides information about the distribution of the spilled light from one zone to the entire screen.

Figure 5:
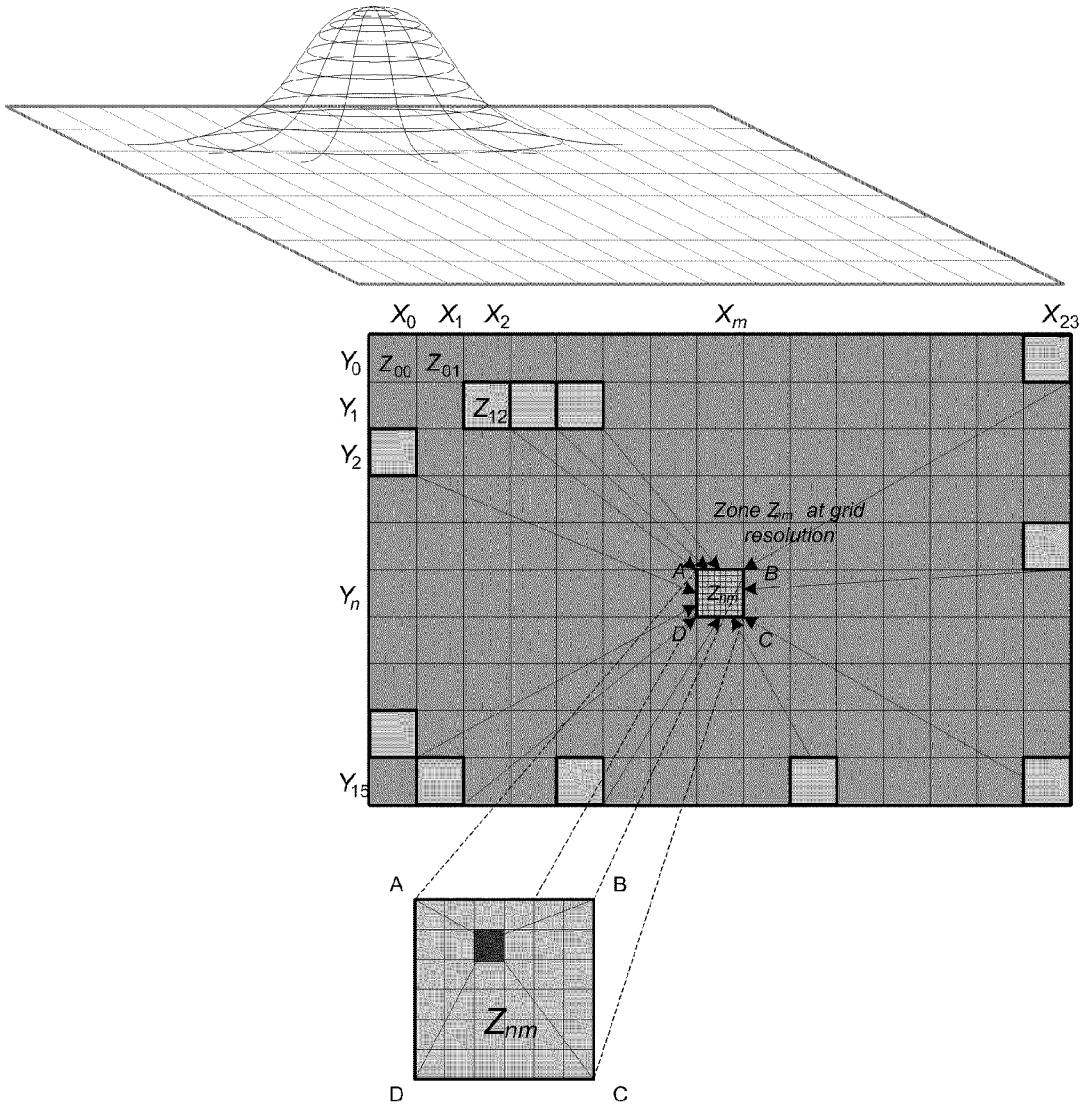
FIG. 5 illustrates an embodiment zone interpolation method.

FIG. 5 illustrates an example zone contour table calculation. When calculating the effect of spilled light at zone $Z_{nm}$ originating from zone $Z_{12}$ the Zone Contour Table is "positioned" at the center of $Z_{12}$ and the data at the four vertices A, B, C and D of $Z_{nm}$ are retrieved from the zone store. In an embodiment, the vertices are at grid resolution, however, other resolutions can be used in alternative embodiments. For every pixel within the grid, the amount of correction is calculated as a linear interpolation of the four vertices. If the pixel is physically close to the upper left corner of the grid, the spilled light at the upper left vertex A may have a predominant effect. If the pixel is closer to the middle of the grid, all four vertices (A, B, C, D) may have an approximately equal contribution for establishing the amount of correction. It should be noted that the amount of spilled light from grid to grid may vary according to other factors besides proximity. For example, the mechanical construction of the display system can affect the relative intensity of spilled light. It should be further noted that other interpolation methods can be used to calculate the effect of spilled light, for example, a quadratic interpolation method.

In an embodiment, grid brightness interpolator 410 block calculates the brightness of the backlight at every pixel location by performing a 2 dimensional linear interpolation of the 4 grid points surrounding a current pixel to control pixel scaling. In alternative embodiments, other interpolation schemes can be used.

In an embodiment, incoming pixel data 422 as processed by input gamma tables 402 is adjusted for varying backlight intensities so that the overall front-of-screen brightness remains unaltered. In order to avoid implementing a hardware divider, brightness values are inverted using an inverse table 412, the result of which is multiplied by the processed pixel data 423 in pixel scaler 416 to produce output pixel signal 420. In alternative embodiments, pixel data 423 can be divided by the output of grid brightness interpolator 410 directly.

Zone brightness formatter 414 formats and processes zone brightness intensity 425 to provide backlight control 418 in a format suitable for a particular LED or LED driver in the backlight. In alternative embodiments, zone brightness formatter 414 can be configured to drive non-LED light sources. For example, a large number of LEDs in a display backlight require many driver ICs. Zone brightness formatter takes zone brightness intensity 425 converts it into PWM information to control the intensity of the LED. For simple LED drivers, modulated on and off signals are sent to the LED drivers. For more sophisticated LED drivers, PWM data and, in some cases, a vertical sync signal, are sent directly to the LED drivers. In some embodiments, zone brightness formatter 414 supports more than one type of LED driver, while in other embodiments a single LED driver is supported. In further embodiments, zone brightness formatter 414 is configured to drive the LEDs directly.

Figure 6A:
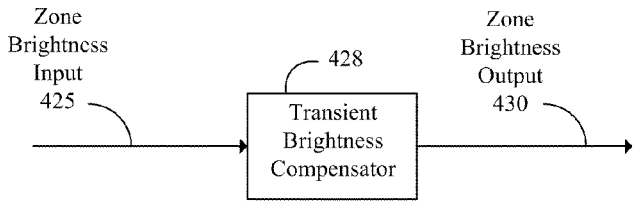
FIGS. 6*a*-6*c* illustrate a block diagram and transient performance of an embodiment transient brightness compensator.

In an embodiment, zone brightness determination block 406 produces a new zone brightness intensity value 425 for every frame. Zone brightness formatter 414 provides intermediate brightness values between frames in order to compensate for the dynamic time response of the LCD pixel plane. In an embodiment, zone brightness formatter 414 has transient brightness compensator 428 that takes zone brightness input 425 and produces zone brightness output values 430, as shown in FIG. 6*a*.

Figure 6B:
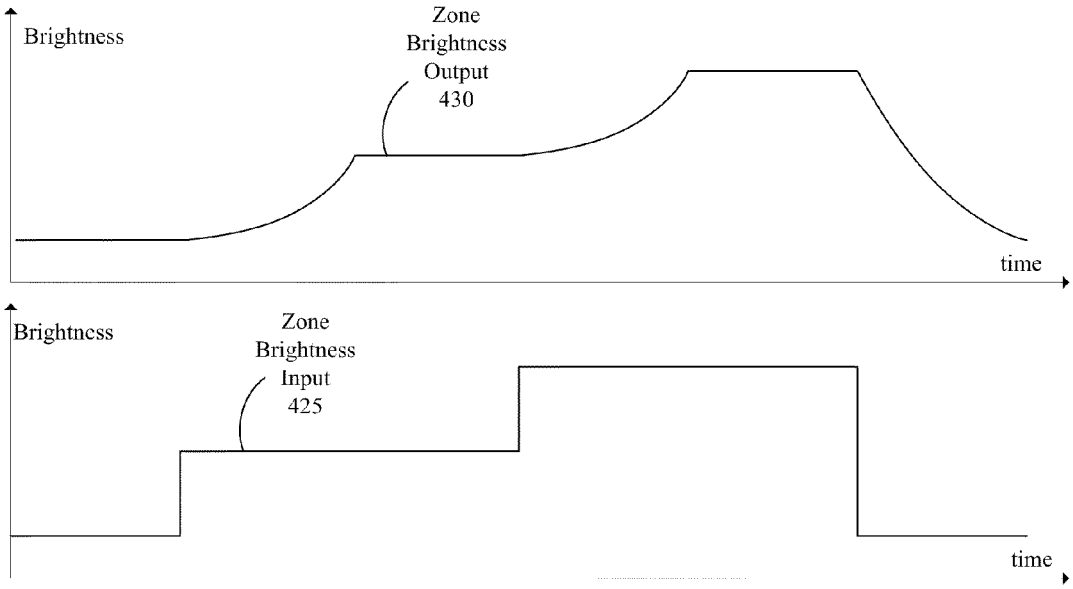

FIG. 6*b* illustrates graphs showing the relationship between input 425 and output 430 of transient brightness compensator 428. In an embodiment, zone brightness input 425 is updated every frame, or at frames in which zone brightness input 425 changes. Zone brightness output 430, on the other hand, has intermediate values that compensate for the time response of the LCD pixel panel.

Figure 6C:
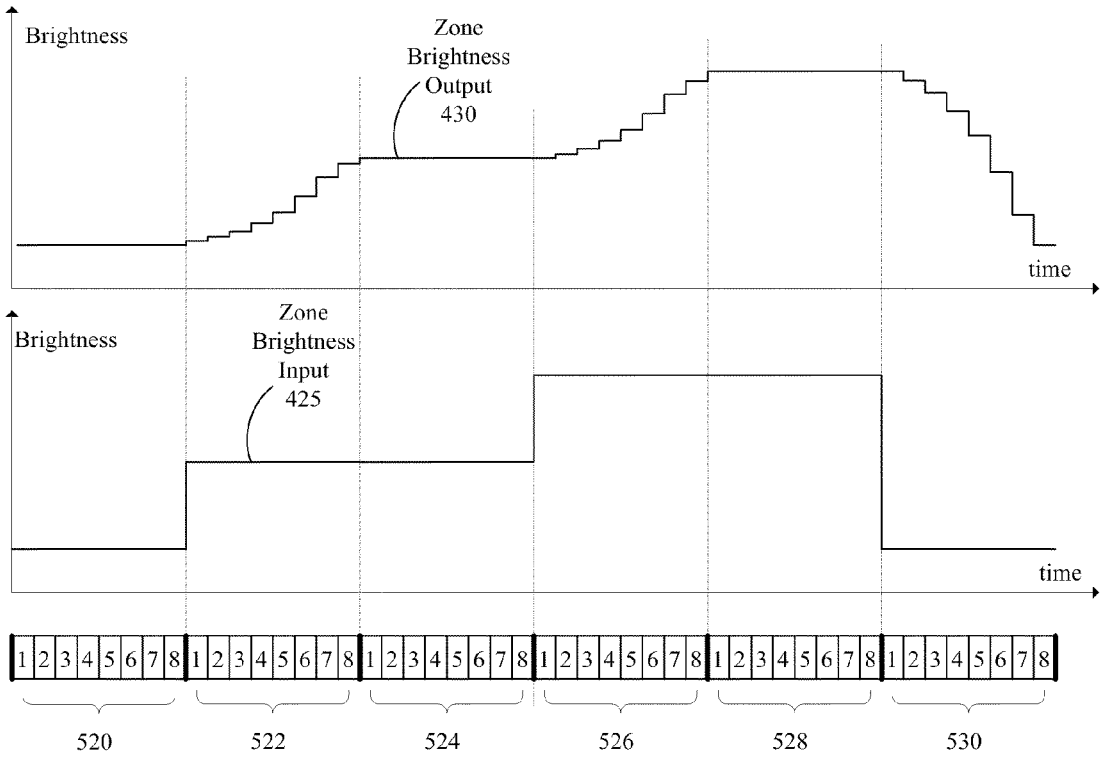

FIG. 6*c* illustrates an embodiment relationship between zone backlight brightness input 425 and zone backlight brightness output 430, in which each frame 520, 522, 524, 526, 528 and 530 are divided into eight segments 1 through 8. In alternative embodiments, each frame 520, 522, 524, 526, 528 and 530 can be divided into greater or fewer sections for updating brightness values. In an embodiment, the value of zone backlight brightness output is updated at each frame sub-segment according to an inverse of the time response of the pixel plane.

Figure 7:
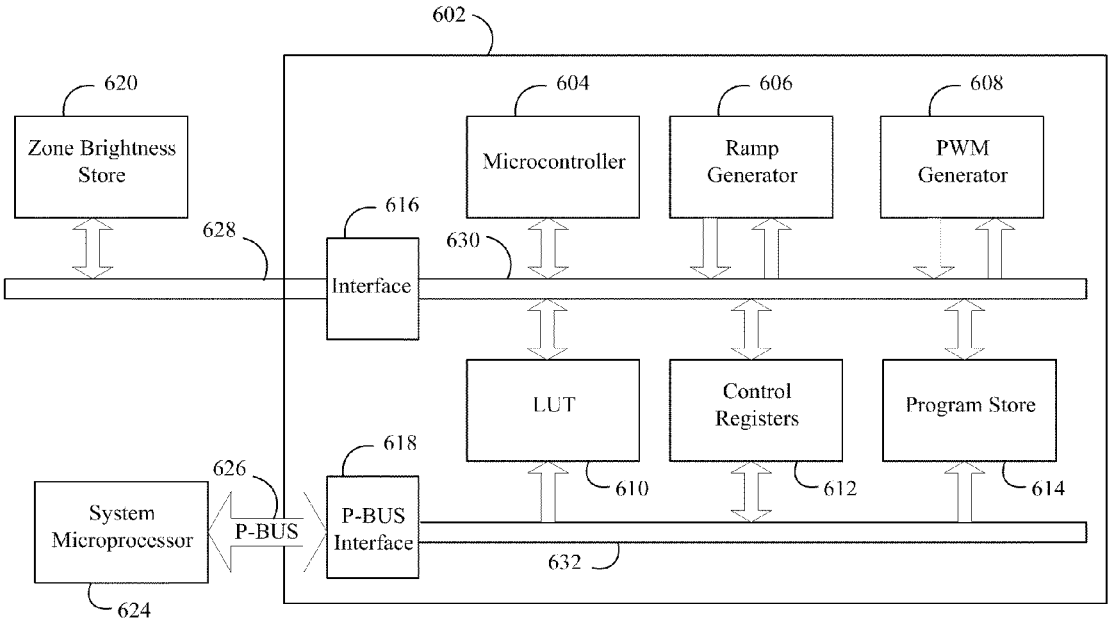
FIG. 7 illustrates an embodiment zone brightness formatter.

FIG. 7 illustrates an embodiment implementation of zone brightness formatter 602. Zone brightness formatter 602 is configured to interface with zone brightness store 620, which is a memory that contains brightness values for ten consecutive frames. In alternative embodiments, greater or fewer frames can be stored in zone brightness store 620. Zone brightness formatter 602 communicates with system microprocessor 624 via P-BUS interface 626.

In an embodiment, zone brightness formatter 602 has interface 616, microcontroller 604, ramp generator 606, PWM generator 608, lookup table (LUT) 610, control registers 612 and program store 614. Interface 616 interfaces with zone brightness store 620 via interface bus 628. Microcontroller 604 controls the operation of zone brightness formatter 602 according to software stored in program store 614. Ramp generator 606 accesses normalized pixel plane transient response data in LUT 610 to generate intermediate brightness values between frames. PWM generator 608 generates PWM driving data for the LEDs in each brightness zone, and control registers 612 provide run-time communication with system microprocessor 624. LUT 610, control registers 612 and program store 614 are also coupled to P-BUS interface 618 via internal bus 632 in order to initialize 610, 612, & 614, & provide run-time communication between control registers 612 and system microprocessor 624.

In some embodiments, zone brightness formatter 602 is implemented using separate components attached to a circuit board, using, for example, separate integrated circuits for some or for all components. Alternatively, some or all of the functionality of zone brightness formatter 602 can be implemented on a single integrated circuit. In some embodiments, zone brightness formatter 602 is implemented as a special purpose microcontroller, with its own instruction set. In some embodiments, zone brightness formatter 602 is configured to communicate with the LED drivers via a variety of communications protocols such as SPI, I2C, simple clocked serial, or parallel data protocols, for example.

Figure 8:
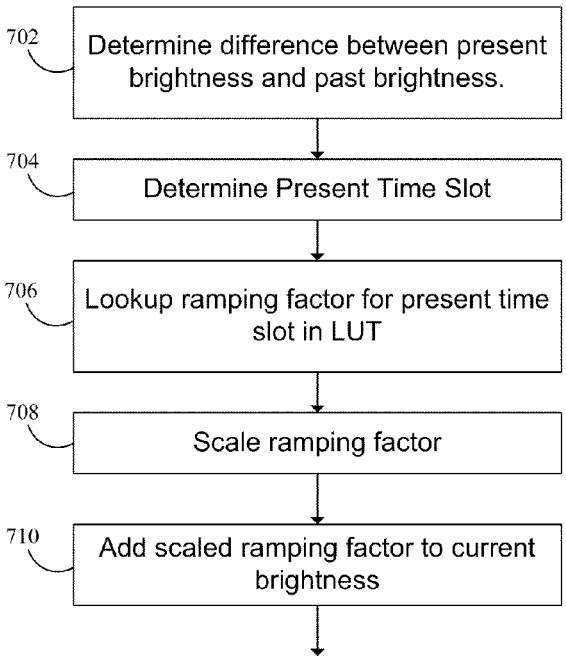
FIG. 8 illustrates an embodiment pixel plane compensation method.

FIG. 8 illustrates an embodiment method for determining intermediate brightness values between frames for a particular brightness zone. In step 702, a difference in brightness between a present brightness and a past brightness is determined. In one embodiment, the past and present brightness correspond to brightness values in consecutive frames. Next, in step 704, a present time slot is determined. In embodiments where a frame is divided into time slots, this present time slot corresponds to a particular sub-frame interval. For example, during step 704, it is determined which of the eight sub-frame intervals is the current time interval.

In step 706, present time ramping factor is determined by accessing a lookup table to determine a ramping factor. In an embodiment, this ramping factor corresponds to a normalized rising and/or falling intensity. In step 708, the ramping factor is scaled to de-normalize the ramping factor, and in step 710, the scaled ramping factor is added to the current frame brightness factor.

In one embodiment, a backlight controller for a zoned backlight display includes a processor having a brightness value output. The processor is configured to provide a brightness value for at least one brightness zone of the display based on a target brightness value for the at least one zone, a past brightness value of the at least one zone, and a brightness time response. In some embodiments, the brightness time response approximates an inverse function of a time response of a pixel plane. In an embodiment, the processor further includes a lookup table containing entries representing the brightness time response. In one embodiment, the processor is disposed on an integrated circuit.

In an embodiment, the backlight controller of further includes a zone brightness determination circuit for determining a target brightness value and the past brightness value based on input pixel data, and a pixel scaler for scaling pixel data for pixel plane by the target brightness value. In an embodiment, the backlight controller further includes an interface coupled to the brightness value output, where the interface is configured to provide a brightness to least one light emitting diode (LED) of the last least one brightness zone. In some embodiments, the backlight controller further includes a PWM generator coupled to the brightness value output.

In another embodiment, a method of operating a display having a pixel plane and a zoned backlight including a brightness zone is disclosed. The method includes providing a present brightness for the brightness zone based on present input pixel data, providing a past brightness for the brightness zone based on past input pixel data, providing a brightness time response for transitioning from the past brightness to the present brightness over a first time period, and changing a brightness of the brightness zone according to the brightness time response over the first time period. In an embodiment, the brightness time response is based on a time response of the pixel plane, and in some embodiments, the brightness time response approximates an inverse function of the time response of the pixel plane. In some embodiments, the brightness time response comprises a time response for an increase in brightness, and a time response for a decrease in brightness, and in some embodiments, the time response for the increase in brightness is faster than the time response for the decrease in brightness.

In an embodiment, changing the brightness includes determining a brightness difference between the present brightness and the past brightness, determining a present time slot, determining a present time slot brightness value based on the brightness difference and the present time slot, and transmitting the present time slot brightness to the brightness zone. In an embodiment, determining the present time slot brightness value includes providing the brightness difference and present time slot to a lookup table, receiving an adjustment factor from the lookup table, scaling the adjustment factor; and adding the adjustment factor to a previous brightness value.

In an embodiment, transmitting the present time slot brightness includes transmitting a control signal to at least one light emitting diode (LED) in the brightness zone. In some embodiments, the method further includes sending pixel data to a portion of the pixel plane disposed in front of the brightness zone.

In a further embodiment, a display system includes a multi-zone light emitting diode (LED) backlight disposed behind a liquid crystal display (LCD) pixel plane, a backlight controller and a pixel plane controller coupled the LCD pixel plane. The backlight controller is coupled to a brightness input of at least one zone of the multi-zone LED backlight. In an embodiment, the backlight controller is configured to provide a brightness value for the at least one zone based on a target brightness value for the at least one zone, a past brightness value for the at least one zone, and a brightness time response. The backlight controller determines the target brightness value and the past brightness value based on pixel data for the at least one zone. In an embodiment, the brightness time response is based on an inverse time function of the LCD pixel plane. In an embodiment, the brightness time response includes a time response for an increase in brightness, and a time response for a decrease in brightness, and in some embodiments, the time response for the increase in brightness is faster than the time response for the decrease in brightness.

It will also be readily understood by those skilled in the art that materials and methods may be varied while remaining within the scope of the present disclosure. It is also appreciated that the present disclosure provides many applicable inventive concepts other than the specific contexts used to illustrate embodiments. Accordingly, the appended claims are intended to include within their scope such processes, machines, manufacture, compositions of matter, means, methods, or steps.

What is claimed is:

1. A backlight controller for a zoned backlight display, the backlight controller comprising:

an input port configured to receive an input video signal, wherein the input video signal comprises frames, each frame of the input video signal containing a single set of pixel data representing a single image; and a zone brightness determination circuit coupled to the input port, the zone brightness determination circuit configured to determine target brightness values for at least one brightness zone of the zoned backlight display based on pixel data in each frame of the input video signal;

a transient brightness compensation circuit coupled to the zone brightness determination circuit, the transient brightness compensation circuit configured to determine intermediate brightness values that transition from a first target brightness value of the target brightness values that correspond to a first frame of the input video signal to a second target brightness value of the target brightness values that corresponds to second frame of the input video signal, wherein the second frame of the input video signal is immediately adjacent to the second frame of the input video signal, the intermediate brightness values are determined according to a brightness time response approximating an inverse function of a transient transparency versus time response of a pixel plane of the zoned backlight display, the transient brightness compensation circuit is configured to determine the intermediate brightness values by determining a ramping factor based on a brightness difference between the second target brightness value and the first target brightness value and based on the brightness time response, scaling the ramping factor, and adding the scaled ramping factor to a current brightness value, and the transient brightness compensation circuit comprises a lookup table configured to produce the ramping factor based on the brightness difference; and a brightness output port coupled to the transient brightness compensation circuit, the transient brightness compensation circuit configured to provide the target brightness values and the intermediate brightness values to the at least one brightness zone of the zoned backlight display.

2. The backlight controller of claim 1, wherein the zone brightness determination circuit and the transient brightness compensation circuit are implemented using a processor.

3. The backlight controller of claim 2 wherein the processor is disposed on an integrated circuit.

4. The backlight controller of claim 3, wherein the processor further comprises a lookup table comprising entries representing the brightness time response.

5. The backlight controller of claim 1, further comprising:

a pixel scaler for scaling pixel data for pixel plane by the target brightness value.

6. The backlight controller of claim 1, further comprising an interface coupled to the brightness output port, the interface configured to provide a brightness to at least one light emitting diode (LED) of the at least one brightness zone.

7. The backlight controller of claim 1, further comprising a PWM generator coupled to the brightness output port.

8. A method of operating a display comprising a pixel plane and a zoned backlight comprising a brightness zone, the method comprising:

providing a past brightness value for the brightness zone based on pixel data of a first frame of an input video signal, the pixel data of the first frame representing a first single set of pixel data for a first single image;

providing a present brightness value for the brightness zone based on pixel data of a second frame of the input video signal, wherein the second frame is immediately adjacent to the first frame, and the pixel data of the second frame represents a second single set of pixel data for a second single image;

providing a brightness time response for transitioning from the past brightness value to the present brightness value over a first time period, wherein the brightness time response approximates an inverse function of a transient transparency versus time response of the pixel plane; and changing a brightness of the brightness zone according to the brightness time response over the first time period, wherein changing the brightness comprises:

changing the brightness from the past brightness value to the present brightness value over intermediate brightness values between consecutive frames, determining a brightness difference between the present brightness value and the past brightness value, determining a present time slot, determining a present time slot brightness value based on the brightness difference and the present time slot, determining the present time slot brightness value comprising determining a ramping factor based on the brightness difference, wherein determining the ramping factor comprises providing the brightness difference and present time slot to a lookup table and receiving the ramping factor from the lookup table, scaling the ramping factor, and adding the scaled ramping factor to a previous slot brightness value to form the present time slot brightness value, and transmitting the present time slot brightness value to the brightness zone.

9. The method of claim 8, wherein the brightness time response comprises a time response for an increase in brightness, and a time response for a decrease in brightness.

10. The method of claim 9, wherein the time response for the increase in brightness is faster or slower than the time response for the decrease in brightness.

11. The method of claim 8, wherein determining the present time slot brightness value comprises:

providing the brightness difference and present time slot to a lookup table;

receiving an adjustment factor from the lookup table;

scaling the adjustment factor; and adding the scaled adjustment factor to a previous brightness value.

12. The method of claim 8, wherein transmitting the present time slot brightness comprises transmitting a control signal to at least one light emitting diode (LED) in the brightness zone.

13. The method of claim 12, further comprising sending pixel data to a portion of the pixel plane disposed in front of the brightness zone.

14. A display system comprising:

a multi-zone light emitting diode (LED) backlight disposed behind a liquid crystal display (LCD) pixel plane;

a backlight controller coupled to a brightness input of at least one zone of the multi-zone LED backlight, the backlight controller configured to:

determine a past brightness value for the at least one zone based on pixel data of a first frame of an input video signal, wherein the pixel data of the first frame of the input video signal represents a first single set of pixel data for a first single image, determine a present brightness value for the at least one zone based on pixel data of a second frame of the input video signal, wherein the second frame is immediately adjacent to the first frame, and the pixel data of the second frame of the input video signal represents a second single set of pixel data for a second single image, determine intermediate brightness values that transition from the past brightness value to the present brightness value, wherein the intermediate brightness values are determined according to a brightness time response approximating an inverse function of a transient transparency versus time response of the LCD pixel plane, determine the intermediate brightness values by determining a brightness difference between the present brightness value and the past brightness value, determining a ramping factor based on the brightness difference, scaling the ramping factor, and adding the scaled ramping factor to a previous brightness value, determine the ramping factor by providing the brightness difference and present time slot to a lookup table, and receiving the ramping factor from the lookup table, and provide the determined intermediate brightness values to the brightness input; and a pixel plane controller coupled to the LCD pixel plane.

15. The display system of claim 14, wherein the brightness time response comprises a time response for an increase in brightness, and a time response for a decrease in brightness.

16. The display system of claim 15, wherein the time response for the increase in brightness is faster than the time response for the decrease in brightness.

* * * * *